US011617431B2

(12) United States Patent
Cheng

(10) Patent No.: US 11,617,431 B2
(45) Date of Patent: Apr. 4, 2023

(54) LOAD-CARRYING FASTENER WITH RAPID ATTACHMENT AND DETACHMENT AND SAFETY LOCK MECHANISMS

(71) Applicant: KANTAS PRODUCTS CO., LTD., Taipei (TW)

(72) Inventor: Yang-Fu Cheng, Taipei (TW)

(73) Assignee: KANTAS PRODUCTS CO., LTD., Taipei (TW)

( * ) Notice: Subject to any disclaimer, the term of this patent is extended or adjusted under 35 U.S.C. 154(b) by 0 days.

(21) Appl. No.: 17/717,003

(22) Filed: Apr. 8, 2022

(65) Prior Publication Data

US 2022/0378181 A1 Dec. 1, 2022

(30) Foreign Application Priority Data

May 27, 2021 (TW) ..... 110206099

(51) Int. Cl.
*A45F 5/02* (2006.01)

(52) U.S. Cl.
CPC ..... *A45F 5/021* (2013.01)

(58) Field of Classification Search
CPC ..... A45F 5/021; A45F 2200/0591; A45F 2200/0575; A45F 2200/0566; F41B 15/02; Y10T 24/4016; Y10T 24/4453; Y10T 24/3407
USPC ..... 224/667, 672
See application file for complete search history.

(56) References Cited

U.S. PATENT DOCUMENTS 6,145,169 A * 11/2000 Terzuola ..... A44B 11/005 24/191
10,362,856 B2 7/2019 Parsons
11,147,360 B2 * 10/2021 Michael ..... A45F 5/021
2006/0101627 A1 * 5/2006 Ida ..... A44B 11/26 24/517

FOREIGN PATENT DOCUMENTS

TW M548987 U 9/2017

OTHER PUBLICATIONS

TW-M548987-U, Sep. 2017, Zheng Yang-Fu. (Year: 2017).*

* cited by examiner

*Primary Examiner* — Adam J Waggenspack
(74) *Attorney, Agent, or Firm* — CIPO IP Group

(57) ABSTRACT

A load-carrying fastener with rapid attachment and detachment and safety lock mechanisms is applicable to an attachable holder for a MOLLE accessory and includes a fastener base; a pivotable locking plate pivotally connectable with the fastener base; and a lock-release key flippable to keep the fastener base and pivotable locking plate in an interlocked or released state. Two lateral sides of the fastener base are formed with elastic arms extending outward to form locking arms with locking hooks. The pivotable locking plate is formed with two locking holes allowing the locking arms to be inserted therein and the locking hooks to hook the edges thereof when being closed on the fastener base, so as to enter into a locked state, and be brought with the fastener base into an unlocked state by disengaging the locking hooks from the hole edges when the elastic arms are pressed.

8 Claims, 13 Drawing Sheets

LOAD-CARRYING FASTENER WITH RAPID ATTACHMENT AND DETACHMENT AND SAFETY LOCK MECHANISMS

CROSS-REFERENCE TO RELATED PATENT APPLICATION

This non-provisional application claims priority to and the benefit of, under 35 U.S.C. § 119(a), Taiwan Patent Application No. 110206099, filed May 27, 2021 in Taiwan. The entire content of the above identified application is incorporated herein by reference.

FIELD

The present disclosure is related to a load-carrying fastener with rapid attachment and detachment and safety lock mechanisms, and more particularly to a load-carrying fastener that includes a fastener base and a pivotable locking plate, for example, a load-carrying fastener that can be applied to an attachable holder for a modular lightweight load-carrying equipment (MOLLE) accessory, which may be used to store and carry the important weapon (e.g., a handgun, police baton, taser, etc.) and auxiliary accessories (e.g., a flashlight, handcuffs, a handheld transceiver, etc.) of a military person or police officer that are needed to be carried when he or she on duty, so that the military person or police officer can easily, rapidly and securely fasten the load-carrying fastener to a carrier (e.g., a leather belt, a duty belt, an equipment belt, a ring fastener sewn on a piece of clothes or on a backpack, etc.) whose specifications (e.g., width) may vary and which is worn on his or her body, or remove the load-carrying fastener from the carrier, and can safely and stably lock the load-carrying fastener to the carrier through the safety locking mechanism of the load-carrying fastener, thereby ensuring that the load-carrying fastener and the attachable holder attached thereto, under no circumstance, will not get loose or fall off either because of an external force such as a pulling, colliding, or severely shaking or swinging force, or because of elastic fatigue of the materials used, or because of wear or damage of related elements, and that the military person or police officer can always use the various important weapon and auxiliary accessories carried by him or her normally and success in his or her assignment.

BACKGROUND

MOLLE is a carrying system developed by the United States Army in the 1990's to enable free attachment of accessories. MOLLE essentially involves adding a plurality of nylon webbing straps to the surface of a carrier (e.g., a tactical pack, tactical vest, duty belt, leather belt, equipment belt, etc.) worn on the body of a military person or police officer so that the military person or police officer can fasten the attachable holders of various MOLLE accessories (e.g., a taser, a flashlight, handcuffs, a hunting knife, a police baton, a handheld transceiver, a handgun, etc.) to selected ones of the nylon webbing straps respectively in order to store and carry with them those MOLLE accessories.

Referring to FIG. 1, which shows a knife designed in accordance with the MOLLE specifications (hereinafter referred to as a MOLLE accessory 50) and its attachable holder 51, the upper side of the attachable holder 51 for the MOLLE accessory 50 is longitudinally provided with a connecting strap 511 and is transversely provided with a plurality of securing straps 513. One end of the connecting strap 511 is fixed, by sewing, to the upper side of the attachable holder 51 at a position adjacent to one end of the attachable holder 51. The middle portion of the connecting strap 511 is sequentially passed under the securing straps 513 and is thus secured on the upper side of the attachable holder 51. The other end of the connecting strap 511 can be fastened, by way of a fastening element 512, to the upper side of the attachable holder 51 at a position adjacent to the other end of the attachable holder 51. The two ends of each securing strap 513 are transversely fixed, by sewing, to the upper side of the attachable holder 51, with a through hole 513*a* formed by and between the middle portion of each securing strap 513 and the upper side of the attachable holder 51. When it is desired to secure the attachable holder 51 to a carrier, the first step is to unfasten the fastening element 512 and remove the connecting strap 511 sequentially from the through holes 513*a*. Then, depending on the length of the connecting strap 511 that is required for securing the attachable holder 51 to the carrier, the other end of the connecting strap 511 is sequentially passed through certain through hole(s) 513*a* between the securing straps 513 and the attachable holder 51. Then, the other end of the connecting strap 511 is passed through the corresponding nylon webbing strap on the carrier and the last through hole 513*a* on the attachable holder 51. Lastly, the fastening element 512 is refastened to the upper side of the attachable holder 51 to position the attachable holder 51 with the MOLLE accessory 50 held thereby securely on the carrier.

Referring to FIG. 1 and FIG. 2, the connecting strap 511 of the attachable holder 51 can be secured in the same way to a duty belt worn around the waist of a military person or police officer to facilitate carrying and use of the MOLLE accessory 50. However, after the attachable holder 51 and the MOLLE accessory 50 held thereby are secured to the duty belt, the MOLLE accessory 50 remains upright near the military person or police officer's waist and therefore cannot be taken out of the attachable holder 51 smoothly; in other words, the military person or police officer must draw the MOLLE accessory 50 out at a relatively unnatural angle. Furthermore, when the military person or police officer is seated, the MOLLE accessory 50 tends to interfere with the seat or a surrounding object and thus cause inconvenience to the military person or police officer. In the light of this, the inventor of the present invention designed an auxiliary structure for use with the MOLLE accessory 50 (Taiwan Utility Model Patent No. M548987), as shown in FIG. 2. The auxiliary structure allows the attachable holder 51 for the MOLLE accessory 50 to be adjusted to the optimal access angle after the attachable holder 51 is attached to a carrier S, so that the military person or police officer wearing the carrier S can access the MOLLE accessory 50 rapidly and easily without feeling any inconvenience in action.

Besides, a military person or police officer on a special duty may have to carry a large number of MOLLE accessories. While a lethal weapon (e.g., a handgun, rifle, submachine gun, etc.) is critical to ensuring personal safety under certain circumstances, it is generally required for a military person or police officer to carry some non-lethal weapons (e.g., a police baton, a taser, a hunting knife, etc.) and auxiliary accessories (e.g., a flashlight, handcuffs, a handheld transceiver, etc.) as well. For example, when arresting a criminal in a crowded place, a police officer generally would not use a lethal weapon, lest any innocent be injured, and in that case, a police baton becomes one of the most likely weapons to be used. Even when the use of a lethal weapon is appropriate, a flashlight may also be needed if the operation in question is performed at night or in a dark building. A flashlight can help spot a criminal in the dark and illuminate the surroundings so that an armed criminal can be tracked down.

Furthermore, when injury takes place at a crime scene or when there are an exceedingly large number of criminals at the crime scene, a handheld transceiver may be needed to seek help or support. If a military person or police officer is to perform duty in the dark, alone, or in a remote area for an extended period of time, it may also be necessary for the military person or police officer to carry spare batteries in case batteries are called for. As the environment in which a military person or police officer performs duty and the properties of the environment are often unusual and subject to rapid changes, it is generally required that the aforesaid weapons and auxiliary accessories be placed near the military person or police officer's body in order to be used at any time to resist unexpected attacks. Attachable holders or fasteners, therefore, are typically used to attach the aforesaid weapons and auxiliary accessories to a carrier (e.g., a leather belt, a duty belt, a strap, a ring fastener on a piece of clothes, a backpack, etc.) worn on the body of a military person or police officer, so that the weapons and auxiliary accessories can be carried around and be accessed whenever needed. The foregoing special use environments and conditions also require that the attachable holders used to hold, support, and facilitate carrying of the aforesaid weapons and auxiliary accessories have such material and structural properties as being lightweight, sturdy, durable, and not prone to catch on an obstacle. For example, when a police officer chasing a criminal is crossing a fence or hedge, the aforesaid weapons or auxiliary accessories may collide with or be entangled with the fence or hedge and thus hinder or delay the arrest. Even worse, the aforesaid weapons or auxiliary accessories may get lost or damaged due to the collision or entanglement such that the police officer cannot use the weapons or auxiliary accessories, and is thus endangered, when those weapons or auxiliary accessories are urgently needed.

To solve the aforementioned issues in the real world, various attachable holders or fasteners for facilitating carrying of the aforesaid weapons or auxiliary accessories were developed in the past twenty to thirty years. However, it remains an important issue to be addressed by the present disclosure to find ways to allow a military person or police officer on duty to equip themselves with various MOLLE accessories 50 rapidly, effortlessly, and correctly and to use those MOLLE accessories 50 effectively and flexibly in urgent conditions. U.S. Pat. No. 10,362,856 B2 (hereinafter, "'856 Patent") is briefly described below by way of example to enable a rapid, clear, and thorough understanding of a fastener for use with the attachable holder of an aforesaid weapon or auxiliary accessory, and to shed light on the technical inadequacies of the prior art in general and the reasons why the prior art has not worked to an extent as intended.

Referring to FIGS. 3-5, '856 Patent provides a fastener system 10 that allows an aforesaid weapon (e.g., a police baton or handgun) or auxiliary accessory (e.g., a flashlight or handheld transceiver) to be rapidly and securely attached to a strap on the clothes of a military person or police officer. The fastener system 10 includes a clip 12, a fastener 56, and an attachable holder 14 (or a similar receptacle). The clip 12 is configured to be clamped on a carrier (e.g., a leather belt, a duty belt, a strap, or a ring fastener sewn on a piece of clothes or on a backpack) worn on the body of a military person or police officer, and to support, secure in place, and allow hanging of the fastener 56. The fastener 56 is made of a flexible fabric or plastic so that the fastener system 10 can be structured in a number of different configurations to carry the attachable holder 14 of an aforesaid weapon or auxiliary accessory of the corresponding type.

In a preferred embodiment of '856 patent, referring to FIG. 4 and FIG. 5, the attachable holder 14 is configured to store and carry a police baton B. The attachable holder 14 is provided therein with a hollow tubular space 140. An upper aperture 141 and a lower aperture 142 are formed at the top and bottom ends of the attachable holder 14 respectively. The apertures 141 and 142 communicate with the hollow tubular space 140. As shown in FIGS. 3-5, the police baton B can be inserted into the hollow tubular space 140 through the upper aperture 141, and the configuration of the hollow tubular space 140 allows the handle portion B1 at the top end of the police baton B to be exposed from, and extend above, the upper aperture 141, and the striking portion B2 at the bottom end of the police baton B to be exposed from, and extend below, the lower aperture 142 while the police baton B is stored and positioned in the hollow tubular space 140. In addition, as shown in FIG. 5, one side of the attachable holder 14 is formed with a slot 143 extending in the longitudinal direction to provide sufficient tolerances for deformation of the hollow tubular space 140. Thus, not only does the police baton B aim to be rapidly and precisely inserted into the attachable holder 14 and held and positioned in the hollow tubular space 140, but also aim to allow a military person or police officer holding the handle portion B1 to easily and rapidly draw the police baton B out of the hollow tubular space 140 in order to use the police baton B.

In the aforesaid embodiment of '856 patent, referring to FIG. 6, the clip 12 generally includes a mounting plate 20, a hinge 24, a cover plate 22, and a spacing adjustment element 40. As shown in FIGS. 3-6, the mounting plate 20 and the cover plate 22 are both elongated in shape and have matching configurations, and a first end of the mounting plate 20 and a first end of the cover plate 22 can be pivotally connected through the hinge 24. One side of the mounting plate 20 is formed with a mounting groove 201 adjacent to the first end of the mounting plate 20. The same side of the mounting plate 20 is protrudingly provided with a resilient lock 26 adjacent to the other end, or second end, of the mounting plate 20. The resilient lock 26 includes a resilient arm 28 and a locking hook 32. The resilient arm 28 is protrudingly provided on and is perpendicular to the aforesaid side of the mounting plate 20. The locking hook 32 is formed at the free end of the resilient arm 28. The cover plate 22 is formed with a locking aperture 30 adjacent to the other end, or second end, of the cover plate 22. The locking aperture 30 and the locking hook 32 correspond to each other and have matching configurations, so that when the mounting plate 20 and the cover plate 22 are clamped on, and hence located respectively on two opposite sides of, a carrier S worn on the body of a military person or police officer and have their second ends abutting against each other, the resilient arm 28 can be passed through the locking aperture 30, with the locking hook 32 hooked to a locking plate 36 formed on the cover plate 22 at a position adjacent to the locking aperture 30, in order for the clip 12 to be clamped on the carrier S, and for the attachable holder 14 hung on the clip 12 to be positioned on the carrier S, thereby allowing the military person or police officer to insert the police baton B (or another MOLLE accessory) into the attachable holder 14.

Furthermore, in order to allow a military person or police officer to clamp the clip 12 on carriers S of different specifications (e.g., of different widths), referring again to FIGS. 3-6, the aforesaid side of the mounting plate 20 in the foregoing embodiment of '856 Patent is concavely provided with a plurality of parallel engaging grooves 202 that are adjacent to the second end of the mounting plate 20 and are sequentially arranged in the longitudinal direction. The cross section of each engaging groove 202 matches the cross section of an engaging rail 41 protrudingly provided on the bottom side of the spacing adjustment element 40, so that depending on the specifications (e.g., width) of the carrier S to be used, a military person or police officer may bring the engaging rail 41 of the spacing adjustment element 40 into alignment with, and engagement in, the corresponding engaging groove 202, in order for the clamping space R formed between the spacing adjustment element 40 and the mounting groove 201 to be sized to allow the clip 12 to be clamped on the carrier S, to whose specifications the engaging groove 202 in use corresponds.

As shown in FIG. 6, the top side of the spacing adjustment element 40 is protrudingly provided with at least one positioning pin 42, and the inner side of the cover plate 22 is concavely provided with a plurality of positioning apertures 54 that are sequentially arranged in the longitudinal direction and correspond in position to the engaging grooves 202. Once the second end of the mounting plate 20 and the second end of the cover plate 22 are made to abut against each other, with the carrier S clamped between the mounting plate 20 and the cover plate 22, the resilient arm 28 can be passed through the locking aperture 30 in order to hook the locking hook 32 to the edge of the locking plate 36, to bring the positioning pin 42 of the spacing adjustment element 40 into engagement in the corresponding positioning aperture 54 in the inner side of the cover plate 22, and to thereby couple the mounting plate 20 and the cover plate 22 together so that the clip 12 is clamped on the carrier S. Thus, the spacing adjustment element 40 contributes to the flexibility and convenience of use of the fastener system 10.

According to the above, the fastener system 10 disclosed in '856 Patent is intended to be adaptable to carriers S of different specifications and thereby provide greater flexibility and convenience of use. However, after using the fastener system 10, it has been found that the structures with which to couple the mounting plate 20 and the cover plate 22 together include, referring to FIG. 7, not only the hinge 24, which pivotally connects the corresponding first ends of the mounting plate 20 and of the cover plate 22, but also passing the resilient arm 28 at the second end of the mounting plate 20 through the locking aperture 30 at the second end of the cover plate 22, and hooking the locking hook 32 at the free end of the resilient arm 28 to the locking plate 36 at the edge of the locking aperture 30.

As can be clearly seen in FIG. 7, the locking hook 32 in '856 Patent depends entirely on a small hooking portion 320 thereof to hook to the locking plate 36. After the resilient arm 28 is passed through the locking aperture 30, the hooking portion 320 is engaged with and hooked to a short engaging wall 360 at the edge of the locking plate 36 thanks to the elasticity of the material of the resilient arm 28, so the hooking force that couples the mounting plate 20 and the cover plate 22 together (i.e., the force that keeps the hooking portion 320 hooked to the engaging wall 360) is in fact rather weak. When the fastener system 10 is subjected to an external force (e.g., a shaking, swinging, colliding, or pulling force), or when the fastener system 10 has been used for so long that elastic fatigue takes place or that the hooking portion 320 or the engaging wall 360 is worn or deformed, the locking hook 32 and the locking plate 36 can be easily driven out of the "locked state", in which the locking hook 32 and the locking plate 36 are hooked to each other, and instead enter the "released state" upon receiving the/an external force. Should that happen, the fastener system 10 may get loose or even fall off while the military person or police officer using the fastener system 10 is on duty, and this could in turn prevent the duty from being carried out, if not causing injury or death of the military person or police officer. Such failure may lead to not only regrettable consequences, but also a loss of confidence in the usefulness and safety of the fastener system among military people and police officers.

Furthermore, after using the fastener system 10 disclosed in '856 patent, it has been found that, referring to FIG. 8, while the structural design that allows the spacing adjustment element 40 to work with the engaging grooves 202 makes it possible for a military person or police officer to take into account the specifications (e.g., width) of the carrier S to be used and then insert the engaging rail 41 of the spacing adjustment element 40 transversely (i.e., in the direction indicated by the double-headed arrow in FIG. 6) into the corresponding engaging groove 202 so that the clamping space R formed between the spacing adjustment element 40 and the mounting groove 201 is sized to allow the clip 12 to be clamped on the carrier S, to whose specifications the engaging groove 202 in use corresponds, the engaging structures between the spacing adjustment element 40 and the mounting plate 20 (i.e., the engaging rail 41 of the spacing adjustment element 40 and the corresponding engaging groove 202 in the mounting plate 20) and the fitting structures between the spacing adjustment element 40 and the cover plate 22 (i.e., the positioning pin 42 of the spacing adjustment element 40 and the corresponding positioning aperture 54 in the inner side of the cover plate 22) are such that a military person or police officer trying to fasten the fastener system 10 to the carrier S worn on their body must align the engaging structures and the fitting structures carefully in order to couple the mounting plate 20 and the cover plate 22 together precisely around the carrier S, to whose specifications the engaging groove 202 in use corresponds, and thereby clamp the clip 12 on the carrier S. Nevertheless, a military person or police officer is often geared up for duty in a hurry or in an urgent manner and therefore may not be able to align the engaging or fitting structures carefully. As a result, the mounting plate 20 and the cover plate 22 may not be coupled together precisely around, let alone clamped securely on, the carrier S, whose specifications may vary. Instead, the mounting plate 20 and the cover plate 22 are very likely to get loose or even fall off while the military person or police officer is on duty, either because of an external force (e.g., a shaking, swinging, colliding, or pulling force), or because of elastic fatigue of the materials used, or because of wear or damage of the hooking portion 320 or the engaging wall 360.

Therefore, the issues to be addressed in the present disclosure include developing and designing a "load-carrying fastener with rapid attachment and detachment and safety lock mechanisms" that not only allows a military person or police officer to easily and rapidly fasten the load-carrying fastener to a carrier worn on their body, but also will not get loose or fall off while the military person or police officer is on duty, as may otherwise occur due to an external force (e.g., a shaking, swinging, colliding, or pulling force), elastic fatigue of the materials used, or wear or damage of the hooking portion 320 or the engaging wall 360. The present disclosure aims to solve issues including that of '856 patent and of its counterparts.

SUMMARY

One aspect of the present disclosure is directed to a load-carrying fastener with rapid attachment and detachment and safety lock mechanisms. The load-carrying fastener is applicable to an attachable holder for a MOLLE accessory (e.g., a handgun, police baton, flashlight, handheld transceiver, etc.), so that the attachable holder can carry the MOLLE accessory and be securely hung on a carrier (e.g., a leather belt, waist belt, equipment belt, or a ring fastener sewn on a piece of clothes or on a backpack), and the MOLLE accessory can be carried and wielded by a military person or police officer at any time. The attachable holder is formed with a storage opening on a lateral side thereof that allows the MOLLE accessory to be passed therethrough and be stored and fastened in a receiving space formed in the attachable holder, and a connecting portion on a rear side of the attachable holder. The load-carrying fastener includes a fastener base, a pivotable locking plate and a lock-release key. The fastener base includes a plate base body. Each of two lateral sides of the plate base body is formed with an elastic arm that extends toward a top side of the plate base body. Compression-recoil gaps are formed between the elastic arms and the plate base body. Each of the compression-recoil gaps allows a corresponding one of the elastic arms to be subjected to an elastic force that pushes the corresponding elastic arm toward the other elastic arm, and to an elastic force that pushes the corresponding elastic arm further away from the other elastic arm. A lock-release space is formed between corresponding inner portions of the elastic arms that are respectively adjacent to the top side of the elastic arms. A rear side of the plate base body is formed with a connecting portion adjacent to the top side of the plate base body. A configuration of the connecting portion of the plate base body matches a configuration of the connecting portion of the attachable holder, so that the plate base body can be attached to the attachable holder through the connecting portions, thereby enabling a military person or police officer to store the MOLLE accessories to be used on his or her duty in the attachable holder, and to carry with him or her and use the MOLLE accessories at any time for emergencies. A top side of each of the elastic arms is formed with a locking arm that extends rearward of the elastic arm, and a free end of the locking arm is formed with a first locking hook. A pivotable locking plate includes a plate body that matches the plate base body in configuration and has a bottom end that can be pivotally connected with the bottom end of the plate base body and allow the plate body to be flipped open from, and closed back on, the rear side of the plate base body. The pivotable locking plate is formed with two locking holes that are adjacent to a top edge of the pivotable locking plate, correspond respectively in position to, and match respectively in configuration, the locking arms and the first locking hooks, and allow the locking arms to be inserted therein respectively when the plate body is closed on the rear side of the plate base body. Each of the first locking hooks can hook a hole edge of a corresponding one of the locking holes to keep the plate body in a locked state in which the plate body is closed on the rear side of the plate base body, so that the plate body and the plate base body can clamp the carrier and allow the attachable holder and any MOLLE accessory stored therein to be swiftly and securely fastened to a person, for example, a military person or police officer. Each of the first locking hooks can be disengaged from the hole edge to bring the plate body to an unlocked state to allow the plate body to be flipped open from the rear side of the plate base body when pressing portions on outer sides, and adjacent to the top edges, of the elastic arms are pressed simultaneously and the elastic arms are brought closer to each other. The lock-release key has a rear side that can be pivotally connected to a top edge of the plate body. The lock-release key matches the lock-release space in configuration, and can be flipped forward to a locking position where the lock-release key is engaged in the lock-release space to keep the pivotable locking plate and the fastener base in an interlocked state, and be flipped rearward to a released state in which the lock-release key is disengaged from the lock-release space. Therefore, the load-carrying fastener can be ensured to be swiftly and securely fastened to a person, for example, a military person or police officer, so that the person can store in the attachable holder, and carry with him, any MOLLE accessory to be used on duty for his or her use whenever needed to deal with an emergency or defuse an imminent crisis.

In certain embodiments, a side of each of the elastic arms that faces the lock-release space is provided with at least one first engaging unit adjacent to the top edge of the elastic arm. Each of two lateral end edges of the lock-release key is provided with at least one second engaging unit matching the first engaging unit in configuration and can engage the first engaging unit to keep the pivotable locking plate and the fastener base securely in combination in the locked state.

In certain embodiments, the plate base is integrally formed of a plasticized material. In certain embodiments, the pivotable locking plate is integrally formed of a plasticized material.

In certain embodiments, the load-carrying fastener further includes a spacing-adjusting insertion member. The spacing-adjusting insertion member includes a left insertion member, a central insertion member and a right insertion member that are transversely arranged. Each of the left and right insertion members is connected to a left or right side of the central insertion member by an elastic arm. A portion of the plate base body along a direction away from the second connecting portion is formed with a plurality of rows of spacing-adjusting insertion hole sets. The rows are arranged in a transverse direction of the plate base body and are parallel to one another. Each of the spacing-adjusting insertion hole sets includes a left insertion hole, a central insertion hole and a right insertion hole that are transversely arranged. Each of the left insertion hole and the right insertion hole is formed with a hooking wall on the inner wall thereof. The left and right insertion members match the left and right insertion holes in configuration, respectively. A front side of each of the left and right insertion members is formed with a second locking hook that matches the hooking wall in configuration and can be hooked to the hooking wall when the left, central and right insertion members are inserted into the left, central and right insertion holes. The spacing-adjusting insertion member can size a clamping space adequate for clamping the carrier that is formed between the fastener base and the pivotable locking plate and between the spacing-adjusting insertion member and the locking arms.

In certain embodiments, a rear side of each of the left insertion member, the central insertion member and the right insertion member is protrudingly formed with a positioning post. The positioning posts match each of the positioning hole sets formed on the pivotable locking plate in configuration and can position the spacing-adjusting insertion member at a predetermined position without getting loose or falling off, and therefore position the load-carrying fastener to stay securely hung on the carrier after the left, central and right insertion members are inserted into the left, central and right insertion holes and the fastener base and the pivotable locking plate are closed with respect to each other around the carrier.

In certain embodiments, the spacing-adjusting insertion member is integrally formed of a plasticized material.

In certain embodiments, the spacing-adjusting insertion member is made of a material with higher elasticity than the plate base body, so that a person, for example, a military person or police officer, can with greater ease insert the spacing-adjusting insertion member into the plate base body or pull the spacing-adjusting insertion member away from the plate base body.

This and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following

DETAILED DESCRIPTION

Figure 1:
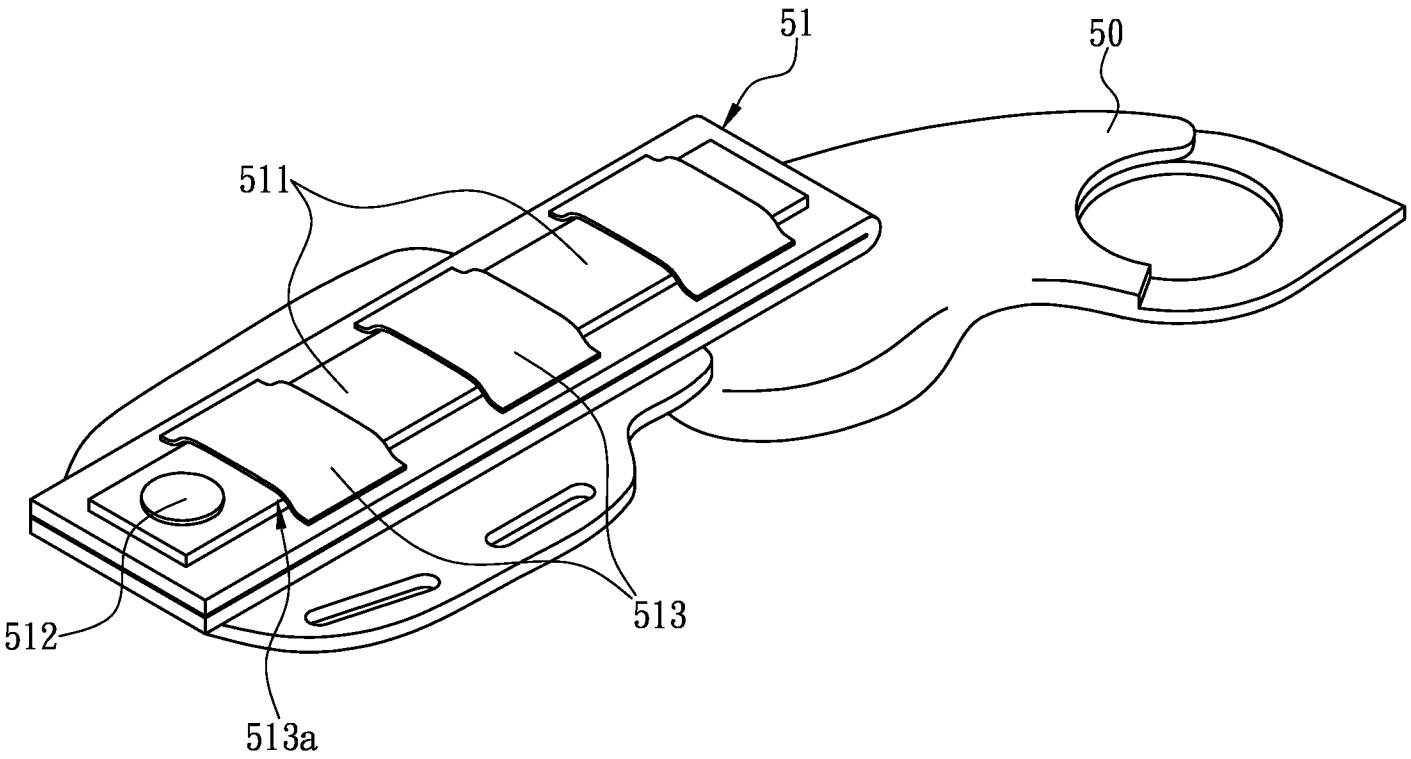
FIG. 1(Prior Art)
FIG. 1 is a schematic diagram of a conventional MOLLE accessory and an attachable holder therefor.
Figure 2:
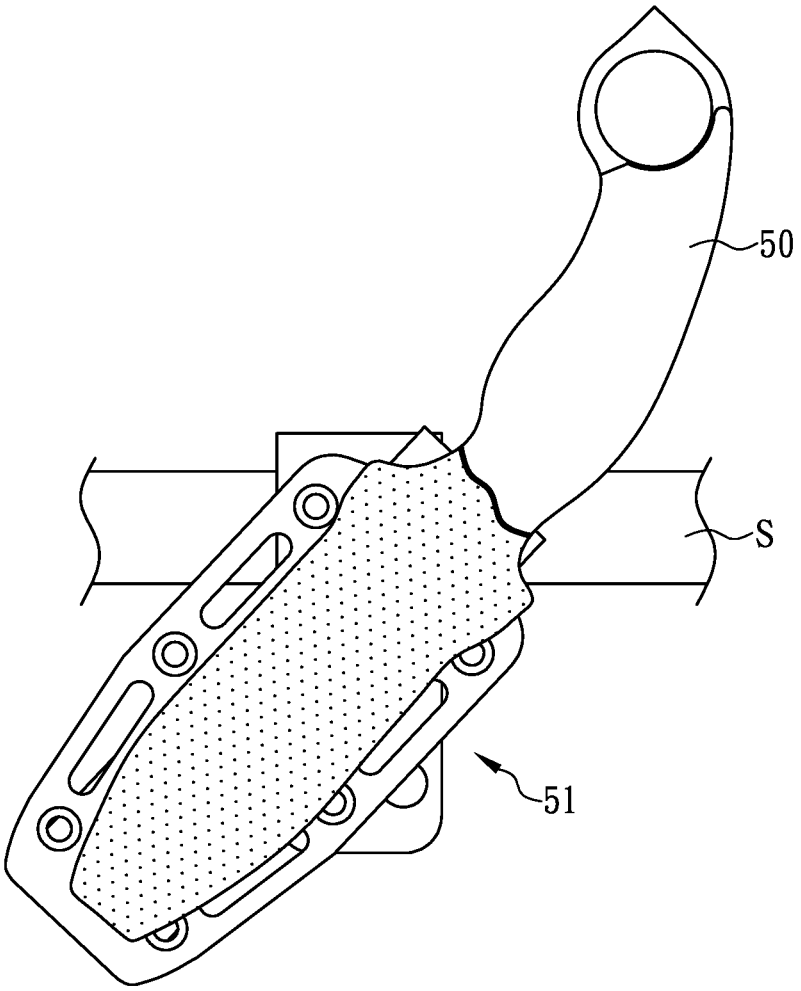
FIG. 2(Prior Art)
FIG. 2 is a schematic diagram of a conventional angle-adjustable load-carrying fastener in a use state.
Figure 3:
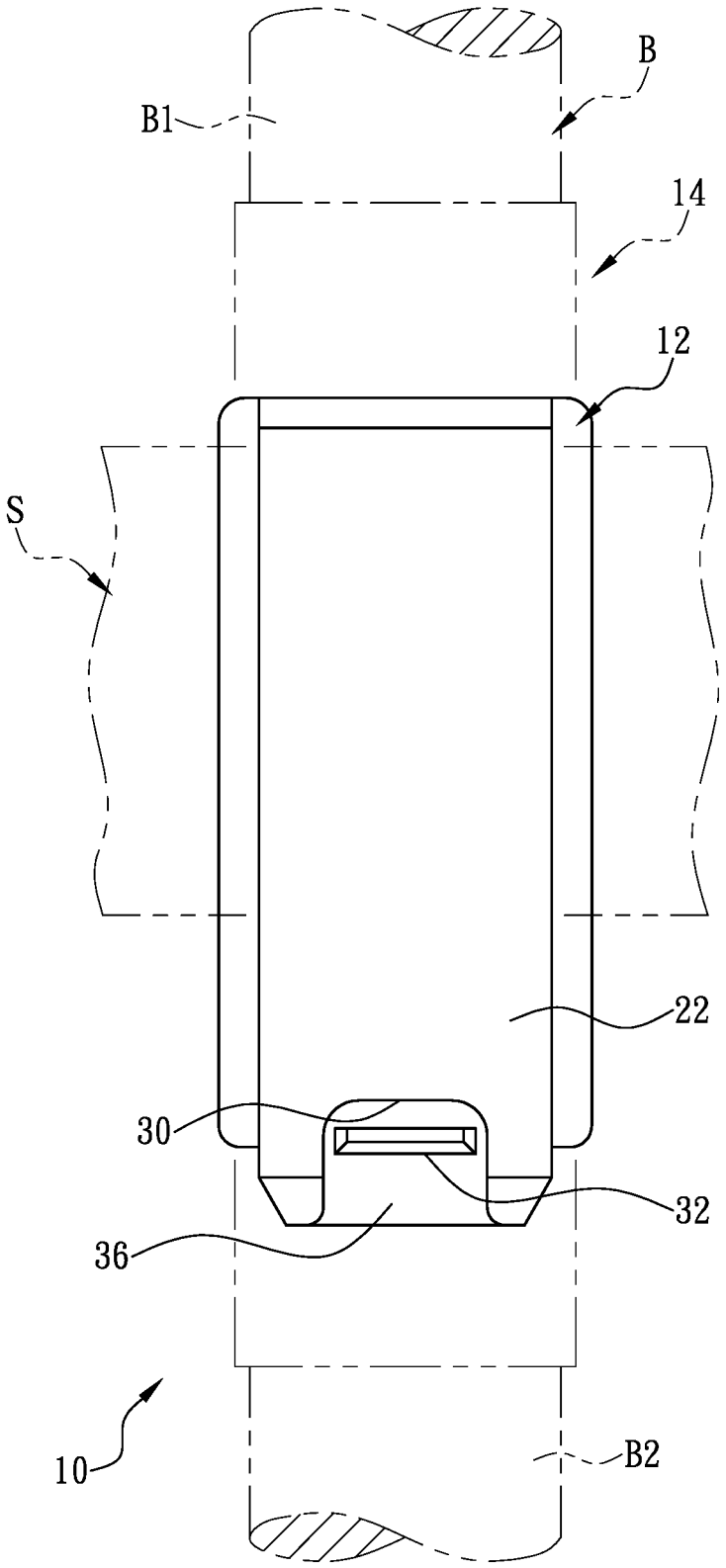
FIG. 3(Prior Art)
FIG. 3 is a front view of a conventional load-carrying fastener in a use state.
Figure 4:
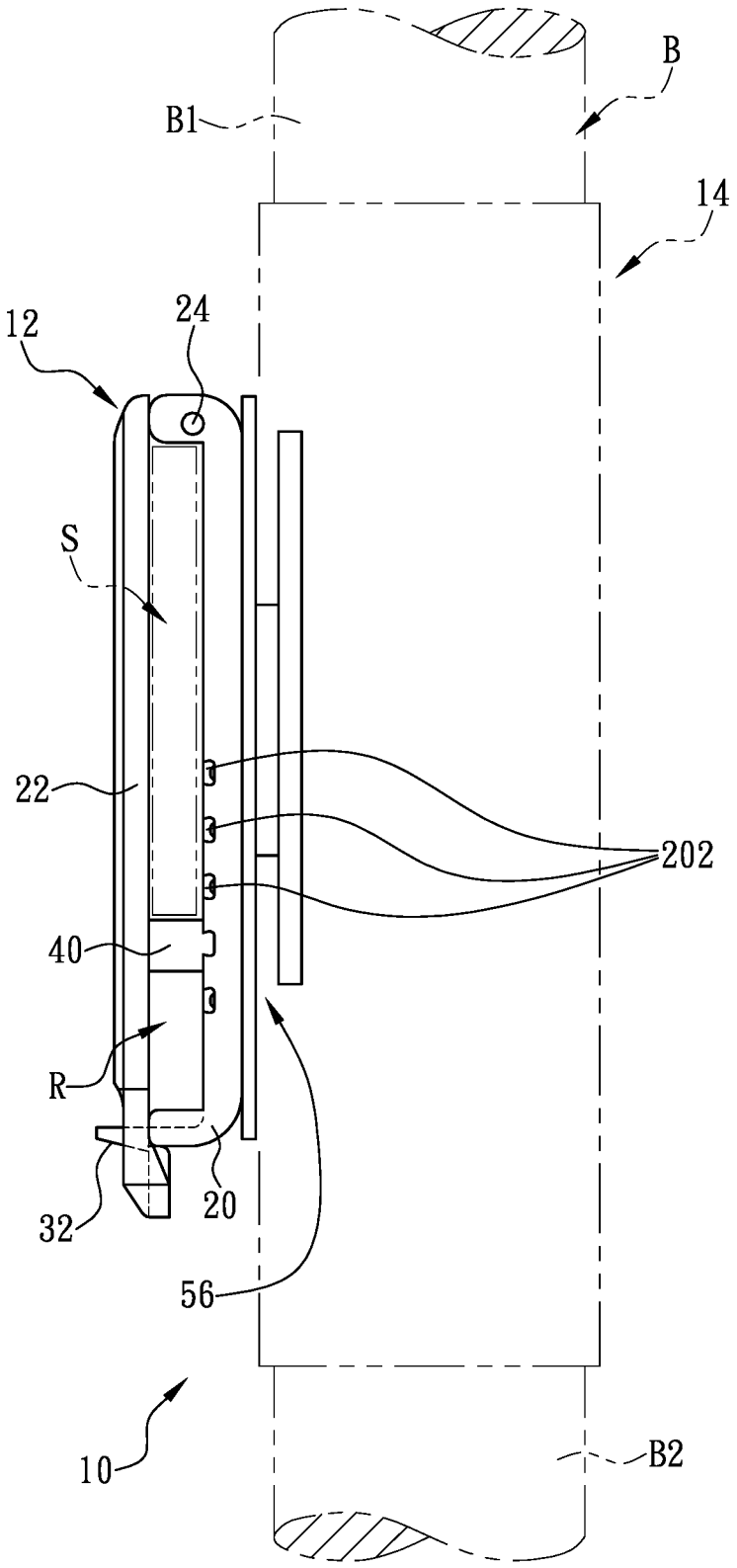
FIG. 4(Prior Art)
FIG. 4 is a side view of the conventional load-carrying fastener in the use state.
Figure 5:
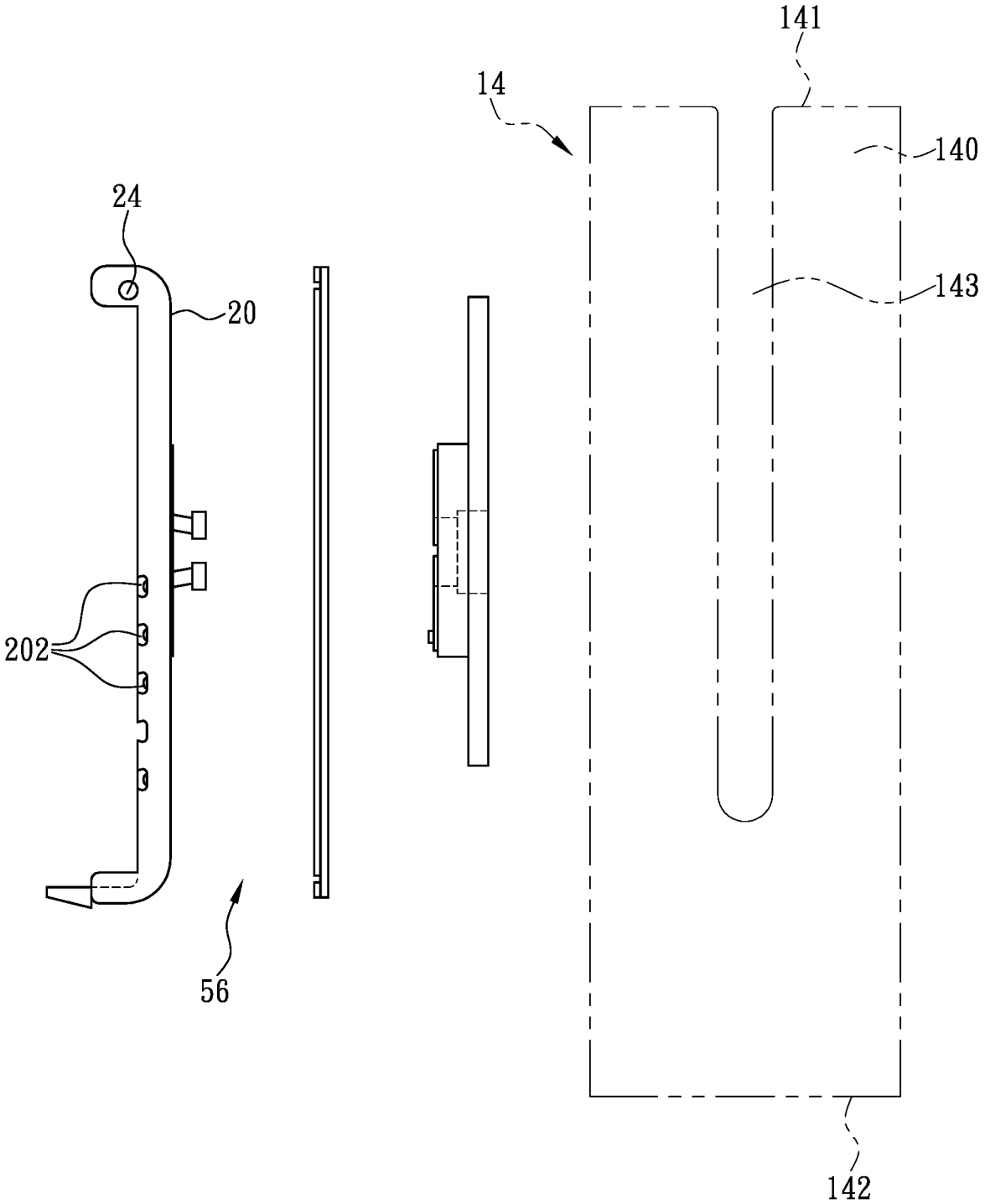
FIG. 5(Prior Art)
FIG. 5 is an exploded view of the conventional load-carrying fastener.
Figure 6:
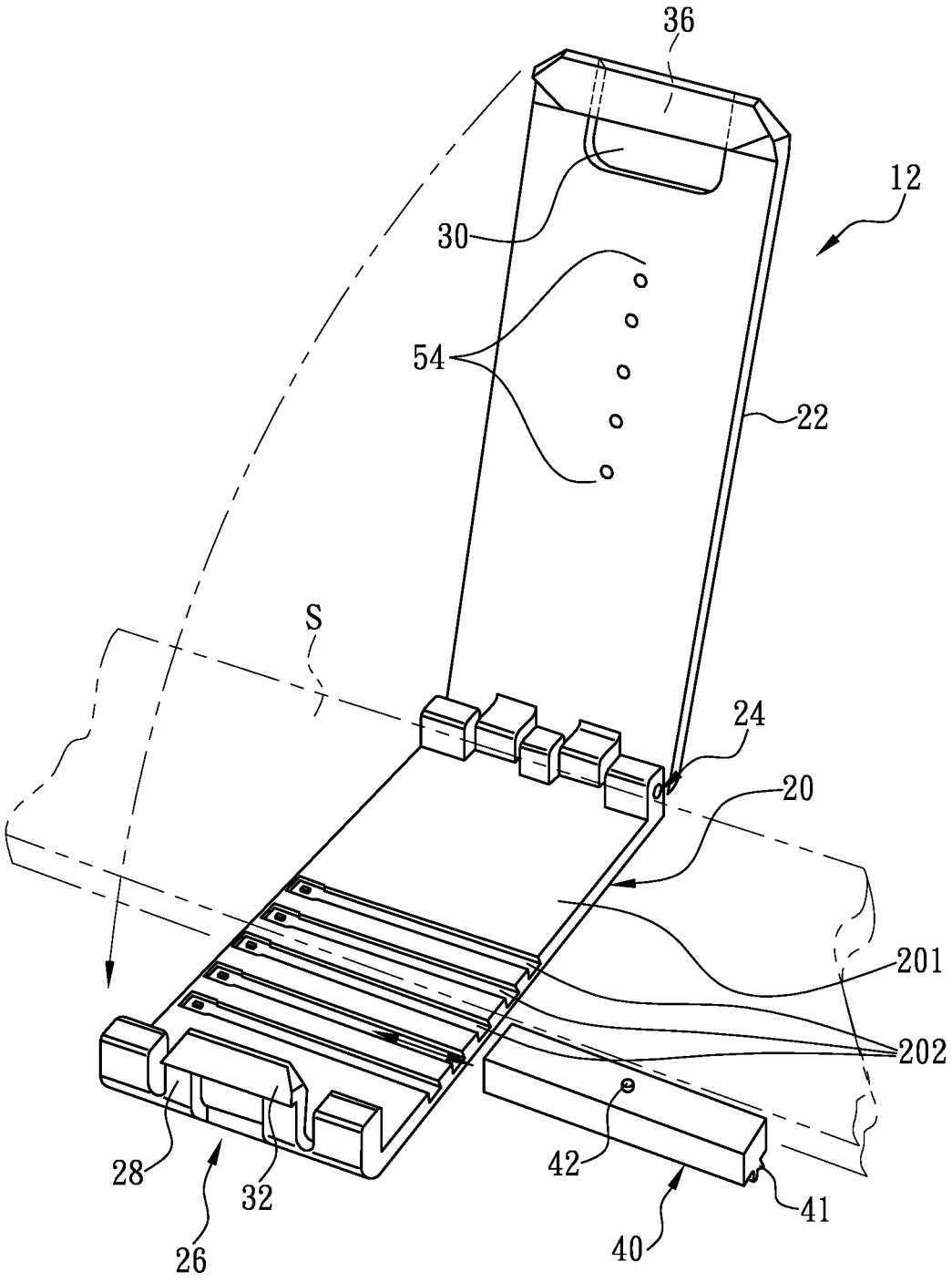
FIG. 6(Prior Art)
FIG. 6 is a perspective view of the conventional load-carrying fastener in the use state.
Figure 7:
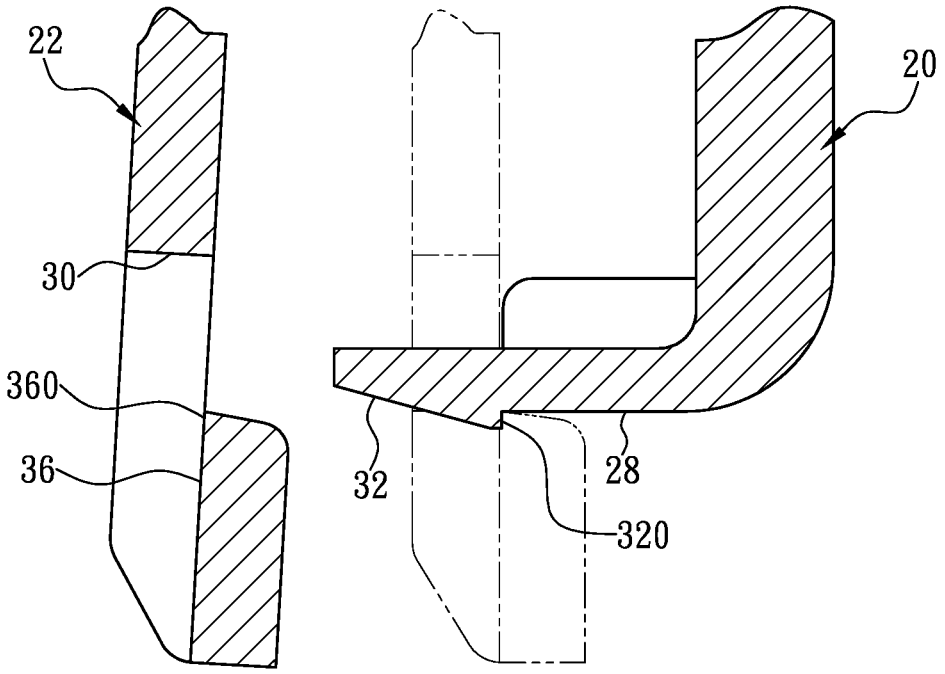
FIG. 7(Prior Art)
FIG. 7 is a cross-sectional view of a portion of the conventional load-carrying fastener in the use state.
Figure 8:
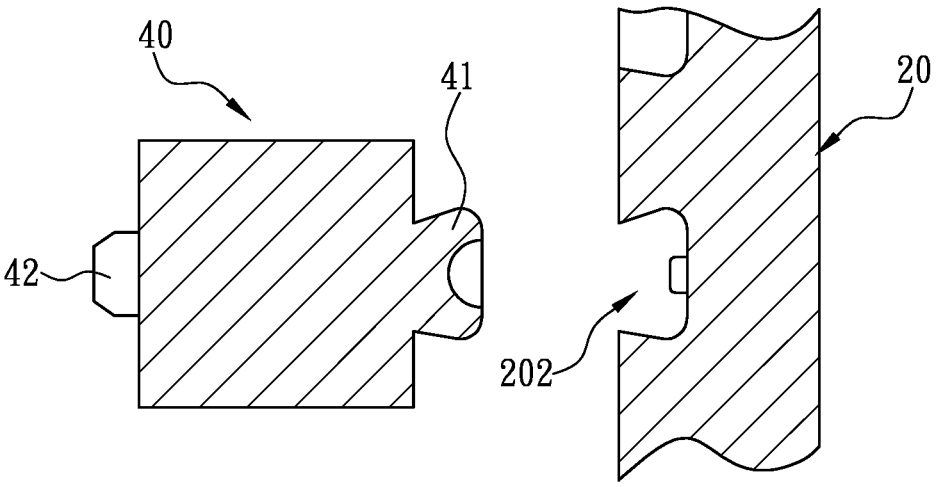
FIG. 8(Prior Art)
FIG. 8 is another cross-sectional view of a portion of the conventional load-carrying fastener in the use state.
Figure 9:
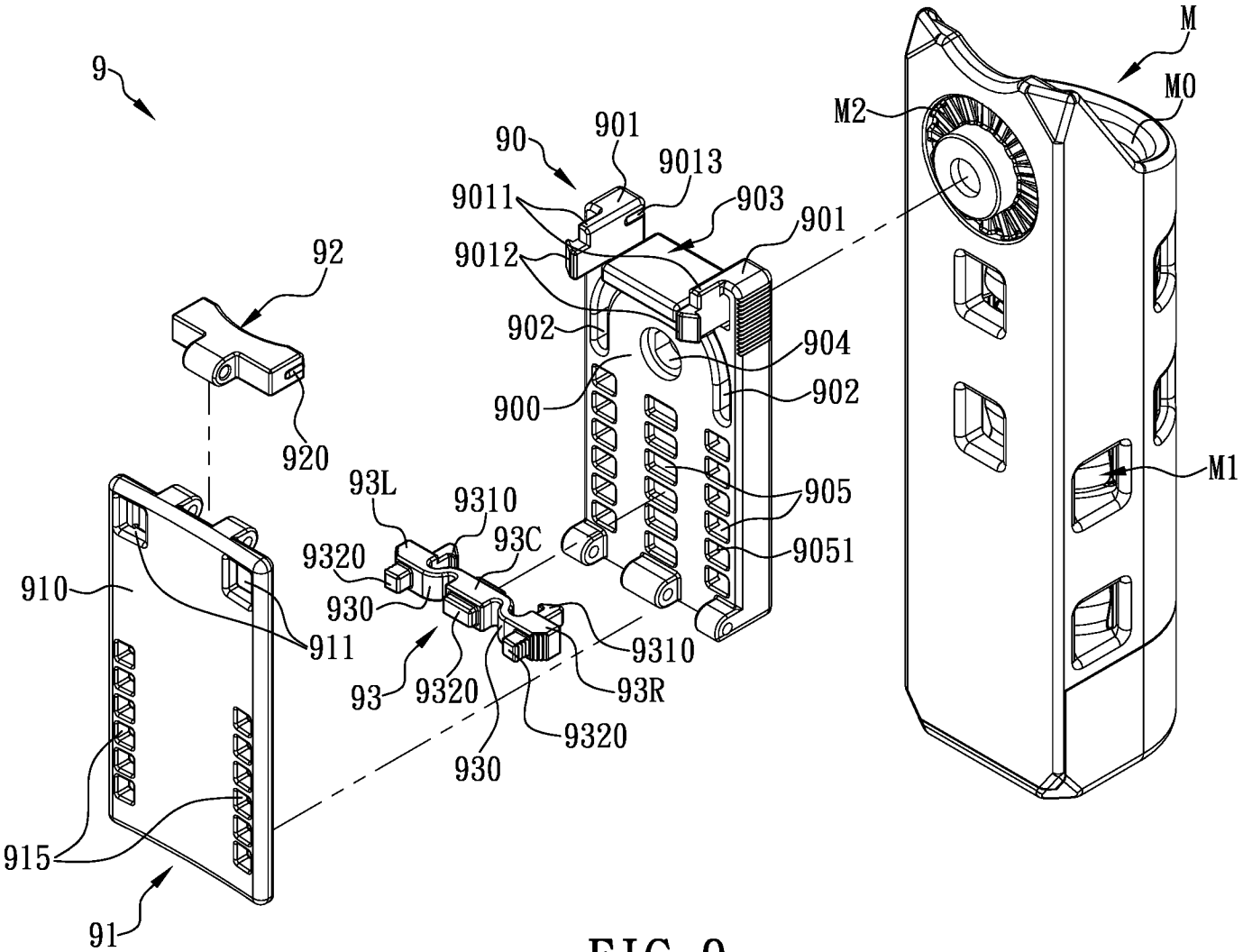
FIG. 9 is an exploded view of a load-carrying fastener according to the present disclosure.

It has been found through research that, although easy to implement and flexible in use, the conventional methods for fastening a MOLLE accessory do not allow angular adjustment, may present difficulties when a military person or police officer is trying to attach a MOLLE accessory to a carrier (e.g., a leather belt, a duty belt, an equipment belt, a ring fastener sewn on a piece of clothes or on a backpack, etc.) worn on their body, and may render the attached MOLLE accessory prone to getting loose or falling off while the military person or police officer is on duty, either because of an external force (e.g., a shaking, swinging, colliding, or pulling force), or because of elastic fatigue of the materials used, or because of wear or damage of related elements (e.g., the foregoing hooking portion 320 or engaging wall 360). As a result of extensive study and repeated experiments, the present disclosure presents a "load-carrying fastener with rapid attachment/detachment and safety lock mechanisms" as shown in FIG. 9, so that a military person or police officer may use the load-carrying fastener as a connection medium between a MOLLE accessory and a carrier. The structures of the load-carrying fastener in the present disclosure includes any structures that serve as the rapid attachment and detachment and safety lock mechanisms of a load-carrying fastener, which allows a military person or police officer to easily, rapidly, and securely attach various MOLLE accessories to a carrier so that the military person or police officer can carry those MOLLE accessories with them and use the MOLLE accessories whenever needed to tackle an emergency taking place while the military person or police officer is on duty.

Referring to FIG. 9, in certain embodiments, a load-carrying fastener 9 can be applied to an attachable holder M (e.g., the sheath of a hunting knife, a police baton holder, the protective holder of a handheld transceiver, a gun holster, etc.) for storing a MOLLE accessory (not shown, e.g., a handgun, hunting knife, taser, police baton, handheld transceiver, etc.). A lateral side of the attachable holder M is formed with a storage opening M0 so that the MOLLE accessory can be passed through the storage opening M0 and then stored and fastened in a receiving space M1 formed in the attachable holder M. The rear side of the attachable holder M is formed with a first connecting portion M2. The first connecting portion M2 not only allows different MOLLE accessories to be securely attached through their respective attachable holders M to a carrier (e.g., a leather belt, a duty belt, an equipment belt, a ring fastener sewn on a piece of clothes or on a backpack, etc.) whose specifications (e.g., width) may vary and which is worn on the body of a military person or police officer, but also allows the angle between each MOLLE accessory and the carrier to be adjusted to the optimal operation angle to meet practical needs, the objective being to enable the military person or police officer to take whichever MOLLE accessory needed (e.g., a hunting knife, police baton, handheld transceiver, handgun, etc.) out of its attachable holder M rapidly and precisely. To facilitate description of the relative positions and connection relationships of the various elements and structures of the load-carrying fastener 9, the "rear side" of the load-carrying fastener 9 is defined as the side facing the lower left corner of each of FIG. 9 to FIG. 13, and the "front side" of the load-carrying fastener 9 is defined as the side facing the upper right corner of each of FIG. 9 to FIG. 13.

In certain embodiments, referring to FIG. 9, the load-carrying fastener 9 includes a fastener base 90 and a pivotable locking plate 91. The fastener base 90 includes a plate base body 900 integrally formed of a plasticized material. Each of two lateral sides of the plate base body 900 is formed with an elastic arm 901 that extends toward the top side of the plate base body 900. Compression-recoil gaps 902 are formed between the elastic arms 901 and the plate base body 900. Each compression-recoil gap 902 allows the corresponding elastic arm 901 not only to be subjected to an elastic force that pushes the corresponding elastic arm 901 toward the other elastic arm 901, but also to an elastic force that pushes the corresponding elastic arm 901 further away from the other elastic arm 901.

A lock-release space 903 is formed between corresponding inner portions of the elastic arms 901 that are respectively adjacent to the top side of the elastic arms 901. The side of each elastic arm 901 that faces the lock-release space 903 is concavely provided with at least one first engaging unit 9013 (e.g., at least one engaging groove) (or is protrudingly provided with at least one first engaging unit 9013 such as at least one engaging tenon) adjacent to the top edge of the elastic arm 901. The rear side of the plate base body 900 is formed with a second connecting portion 904 adjacent to the top side of the plate base body 900. The configuration of the second connecting portion 904 matches that of the first connecting portion M2 so that the attachable holder M can be fastened (or pivotally connected) to the plate base body 900 through the first connecting portion M2 and the second connecting portion 904, allowing a military person or police officer to store the MOLLE accessory to be used on duty in the attachable holder M, to carry the MOLLE accessory with them conveniently, and to use the MOLLE accessory whenever needed to deal with an emergency or crisis that occurs while the military person or police officer is on duty.

Figure 10:
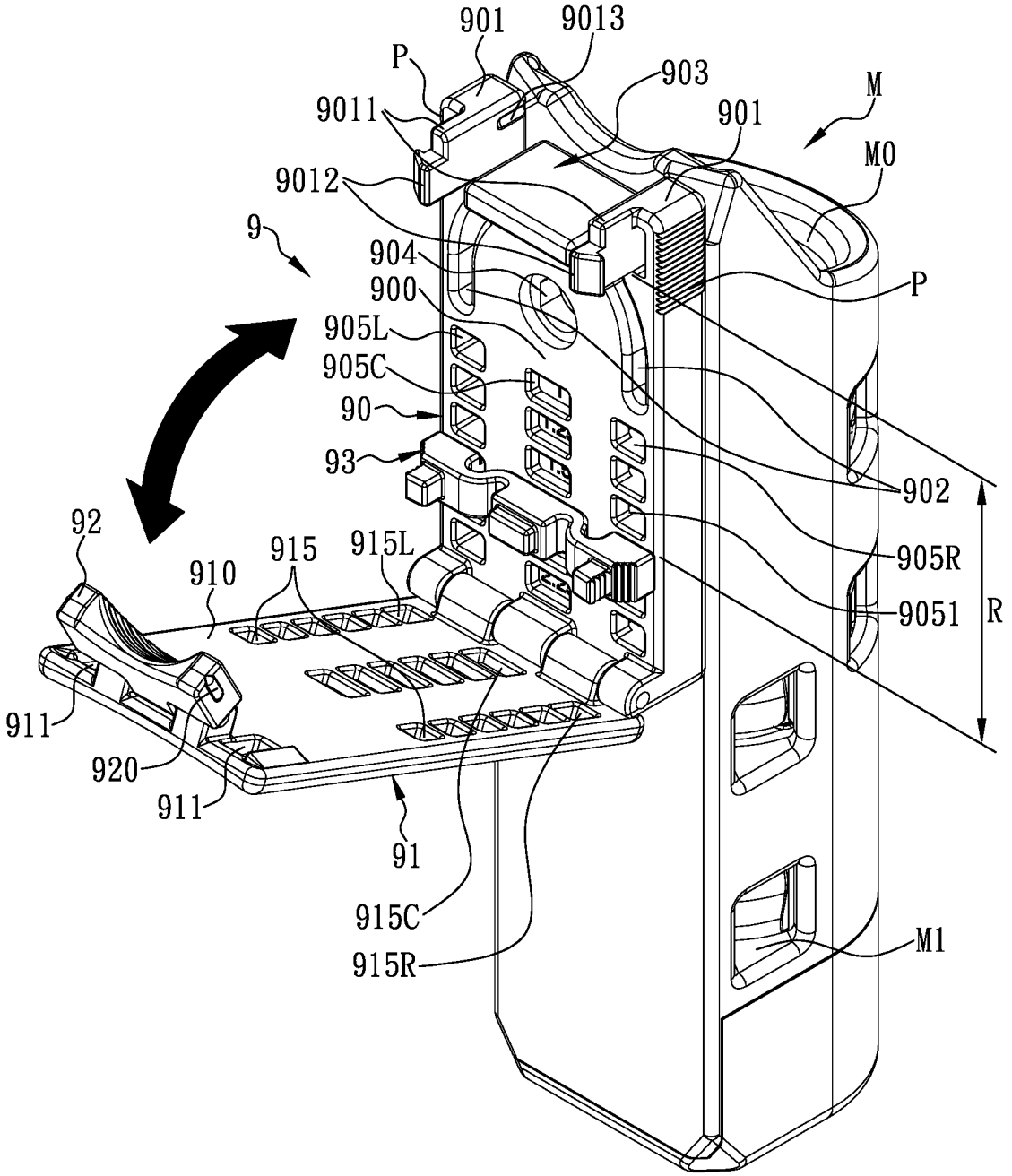
FIG. 10 is a schematic diagram of the load-carrying fastener in use according to the present disclosure.
Figure 11:
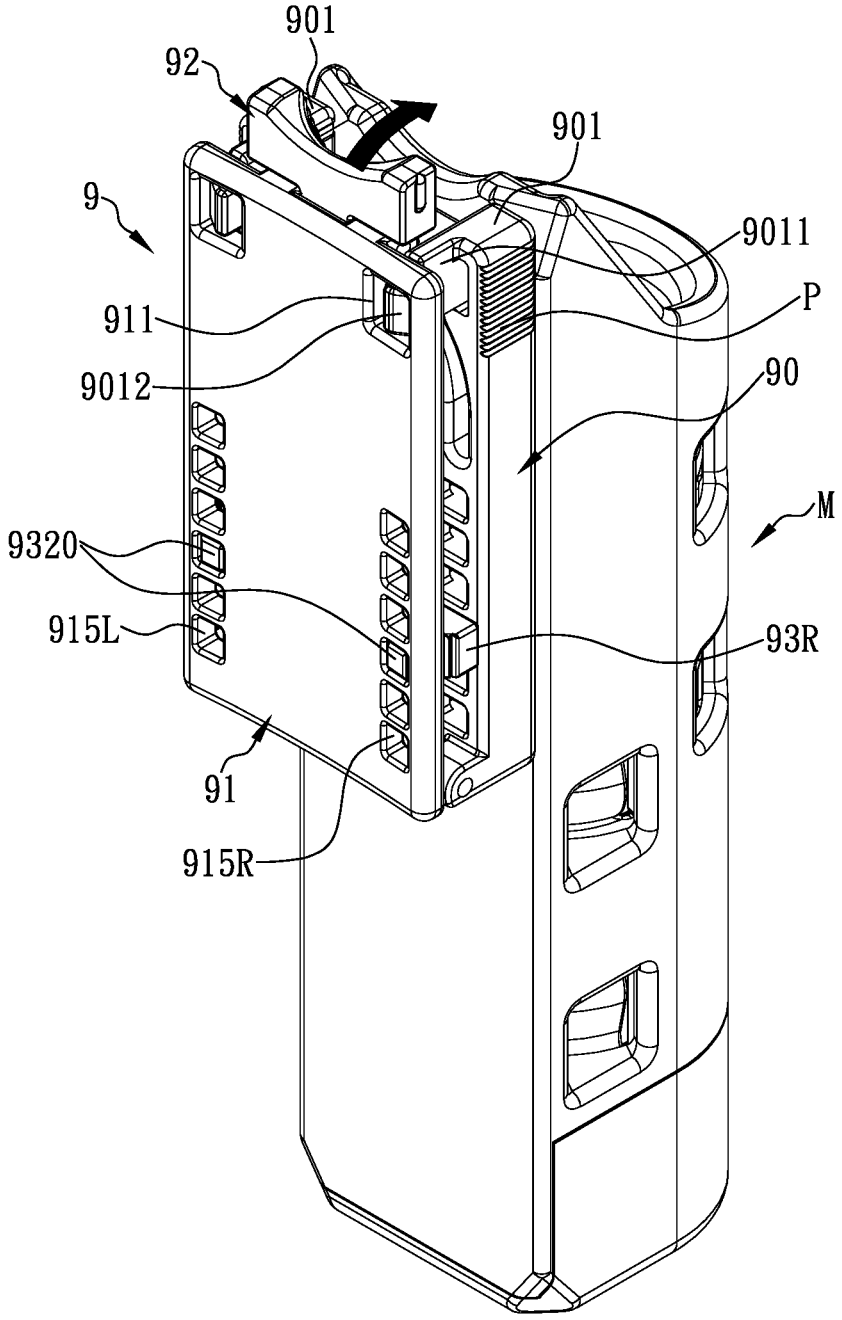
FIG. 11 is a schematic diagram of the load-carrying fastener in a locked state according to the present disclosure.
Figure 12:
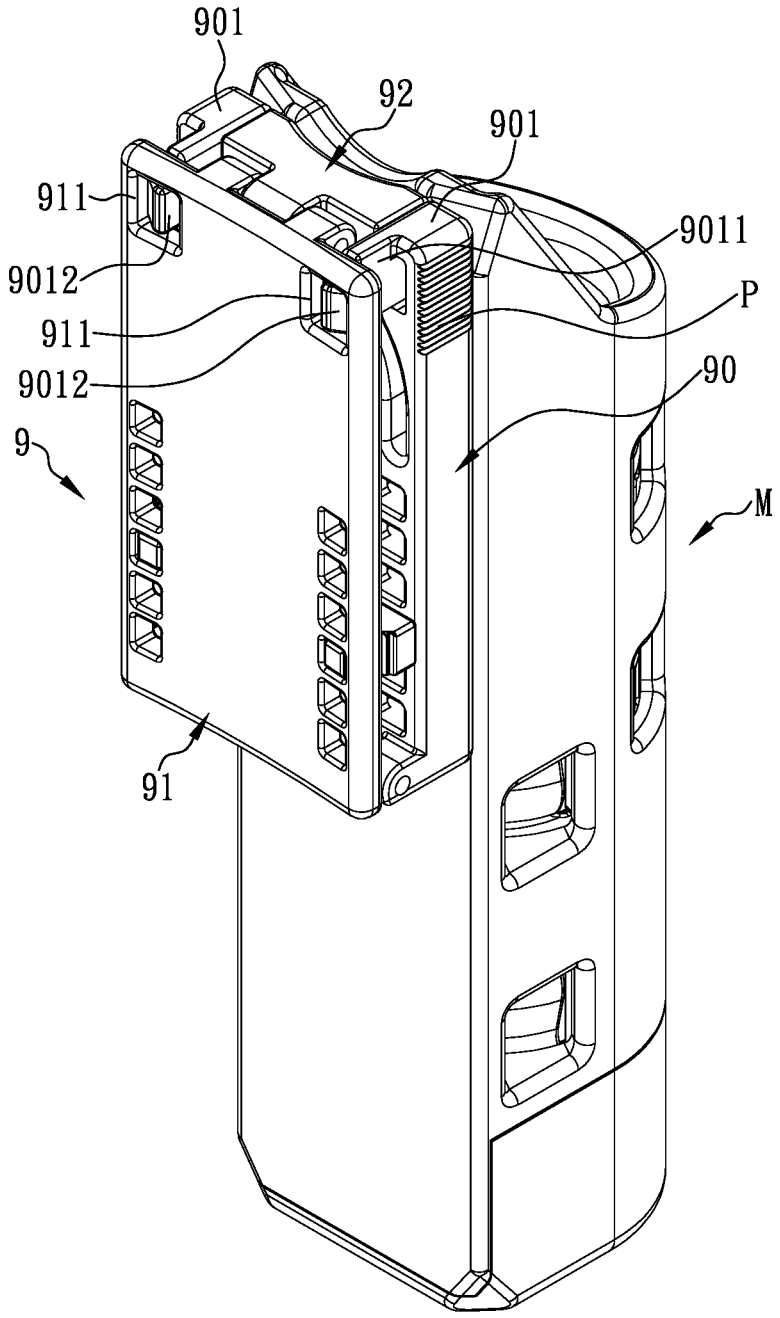
FIG. 12 is a schematic diagram of the load-carrying fastener in an interlocked state according to the present disclosure.
Figure 13:
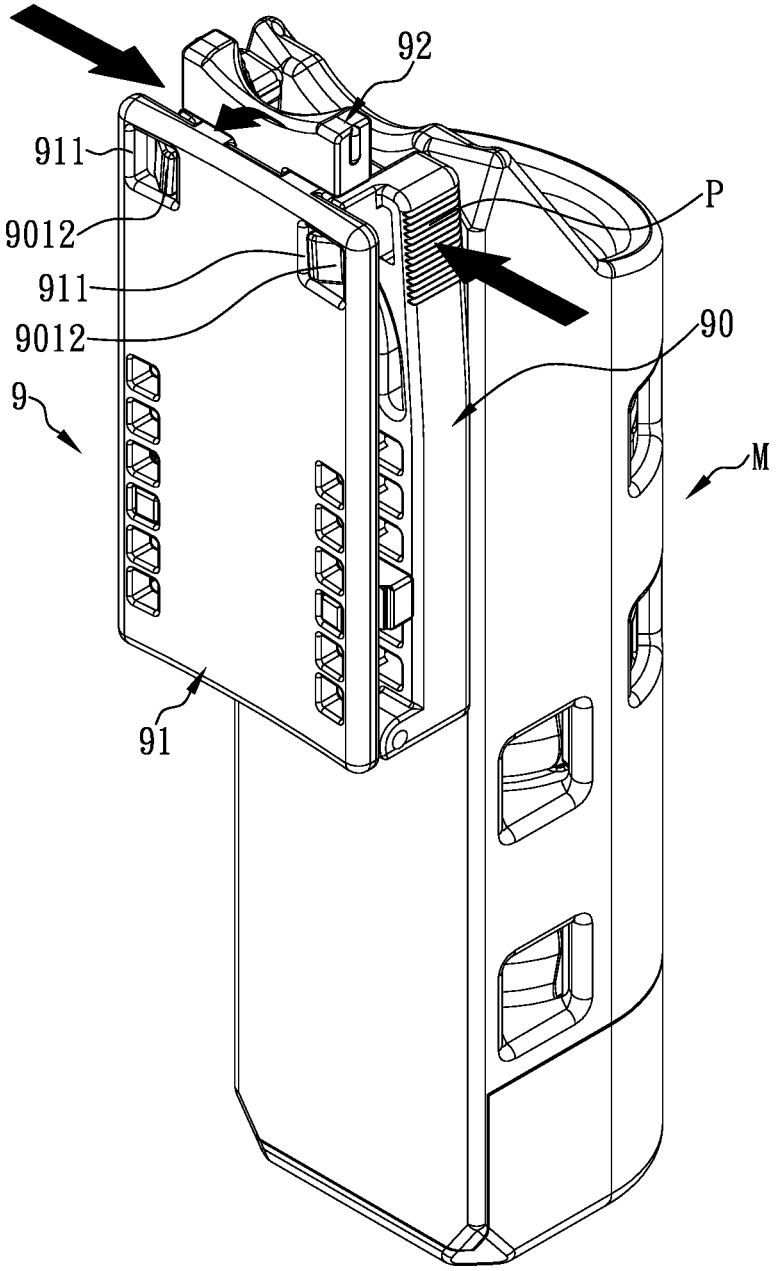
FIG. 13 is a schematic diagram of the load-carrying fastener in an unlocked or released state according to the present disclosure.

With continued reference to FIG. 9, the top side of each elastic arm 901 is formed with a locking arm 9011 that extends rearward of the elastic arm 901, and the free end of each locking arm 9011 is formed with a locking hook 9012. Referring to FIG. 10, the pivotable locking plate 91 includes a plate body 910 integrally formed of a plasticized material. The plate body 910 matches the plate base body 900 in configuration so that the bottom end of the plate base body 900 and the bottom end of the plate body 910 can be pivotally connected, allowing the plate body 910 to be flipped open from, and closed back on, the rear side of the plate base body 900 (as indicated by the double-headed arrow in FIG. 10). The pivotable locking plate 91 is formed with two locking holes 911 that are adjacent to the top edge of the pivotable locking plate 91 and correspond in position to the locking arms 9011, respectively, and hence the locking hooks 9012, respectively. Each locking hole 911 matches the corresponding locking arm 9011 and corresponding locking hook 9012 in configuration so that when the plate body 910 is closed on the rear side of the plate base body 900, referring to FIG. 10 and FIG. 11, each locking arm 9011 can be inserted into the corresponding locking hole 911 to hook the corresponding locking hook 9012 to the hole edge of the corresponding locking hole 911, thereby keeping the plate body 910 in a "locked state", in which the plate body 910 is closed on the rear side of, and combined as a whole with, the plate base body 900, and in which the plate body 910 and the plate base body 900 can securely clamp a carrier therebetween, as shown in FIG. 12. Only when the pressing portions P (each of which is provided on the outer side, and adjacent to the top side, of one of the elastic arms 901) are pressed simultaneously (as indicated by the two opposing arrows in FIG. 13), for example, by a military person or police officer using the load-carrying fastener 9, to bring the elastic arms 901 closer to each other and thereby move and disengage each locking hook 9012 away from the position where it is hooked to the hole edge of the corresponding locking hole 911 will the plate body 910 be brought back to the "unlocked state", in which the plate body 910 can be flipped open from the rear side of the plate base body 900. The foregoing configurations ensure that the load-carrying fastener 9 can be rapidly and securely attached to the carrier worn on the body of a military person or police officer, allowing the military person or police officer to store the MOLLE accessories to be used on duty in their respective attachable holders M, to carry those MOLLE accessories with them conveniently, and to use the MOLLE accessories whenever needed to deal with an emergency or defuse an imminent crisis.

To further keep the fastener base 90 and the pivotable locking plate 91 of the load-carrying fastener 9 closed with respect to each other after the fastener base 90 and the pivotable locking plate 91 are clamped on a carrier (i.e., to keep the fastener base 90 and the pivotable locking plate 91 clamped on, or locked to, the carrier and hence in an "interlocked state", in which the fastener base 90 and the pivotable locking plate 91 cannot be separated from each other), regardless of the conditions the load-carrying fastener 9 may be in (e.g., being violently shaken, swung, hit, pulled, etc.), in certain embodiments, referring to FIG. 9, the load-carrying fastener 9 further includes a lock-release key 92. As shown in FIG. 9 and FIG. 10, the rear side of the lock-release key 92 can be pivotally connected to the top edge of the plate body 910, and the lock-release key 92 matches the lock-release space 903 in configuration so that when the pivotable locking plate 91 is closed on the rear side of the plate base body 900 and hence combined as a whole with the fastener base 90 (i.e., in the locked state), referring to FIG. 11, the lock-release key 92 can be flipped forward (as indicated by the arrow in FIG. 11) to a locking position, where the lock-release key 92 is engaged in the lock-release space 903. Referring to FIG. 9 and FIG. 10, each of the two lateral end edges of the lock-release key 92 is protrudingly provided with at least one second engaging unit 920 (e.g., at least one engaging tenon) (or is concavely provided with at least one second engaging unit 920 such as at least one engaging groove), and the second engaging units 920 match the first engaging units 9013 in configuration so that each second engaging unit 920 and the corresponding first engaging unit 9013 can engage with each other, as shown in FIG. 12, thereby further keeping the pivotable locking plate 91 and the fastener base 90 securely coupled together, i.e., in a further "interlocked state". Unless the lock-release key 92 is flipped rearward (as indicated by the middle arrow in FIG. 13) back to a "released state", in which the lock-release key 92 is not engaged in or disengaged from the lock-release space 903, the pivotable locking plate 91 and the fastener base 90 will stay in the "interlocked state", in which the pivotable locking plate 91 and the fastener base 90 are closed with respect to, and cannot be separated from, each other. It is thus ensured that, once clamped on a carrier, the load-carrying fastener 9 will in no circumstances (be they violent shaking, swinging, collision, pulling, etc.) get loose or fall off from the carrier and thus hinder the performance of duty. In certain embodiments however, the first engaging units 9013 and the second engaging units 920 may be dispensed with, as long as the lock-release key 92 can be flipped into engagement in the lock-release space 903 to keep the pivotable locking plate 91 and the fastener base 90 in the interlocked state.

Figure 14:
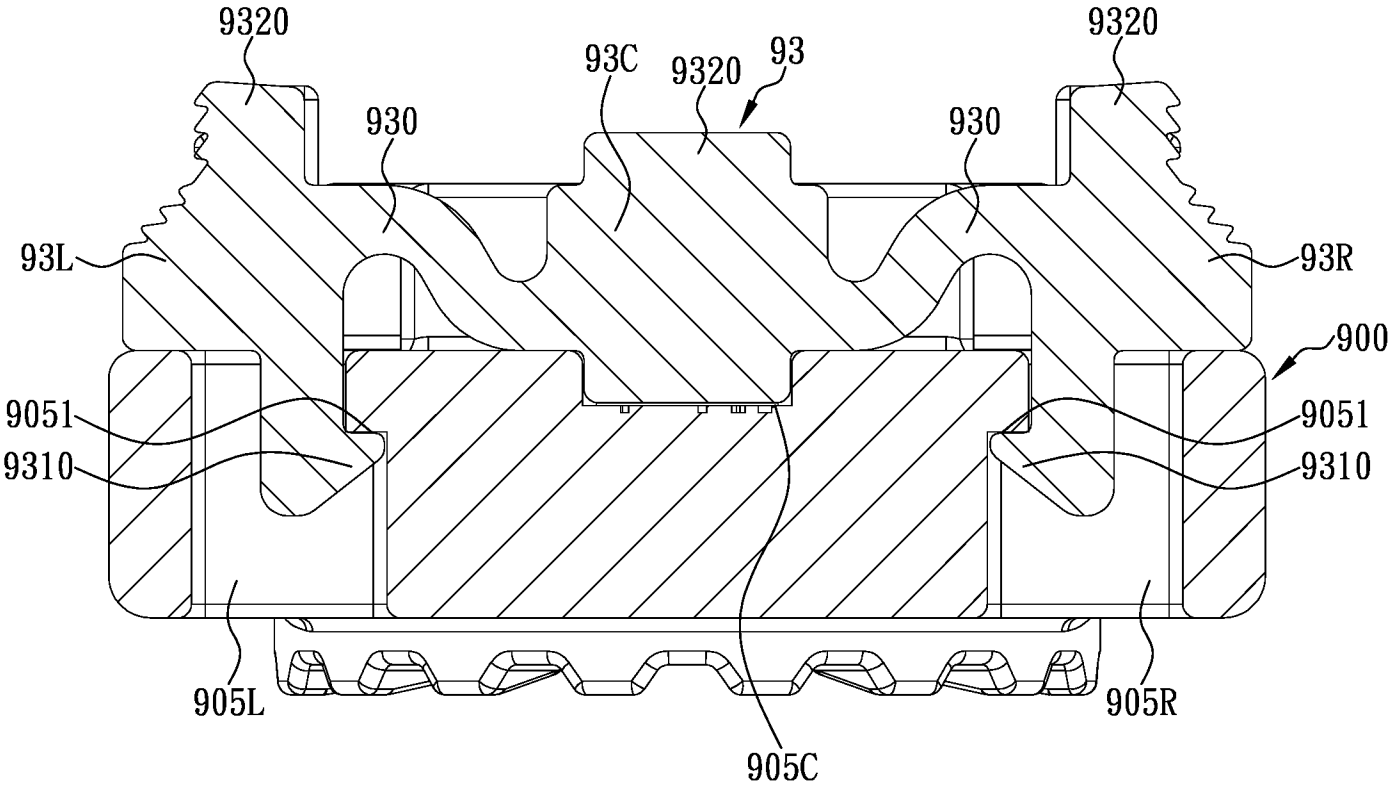
FIG. 14 is a cross-sectional view of a portion of the load-carrying fastener according to the present disclosure.

Moreover, in order to further adapt the load-carrying fastener 9 to differently sized carriers that may be worn by a military person or police officer, in certain embodiments, referring to FIG. 9 and FIG. 10, a portion of the plate base body 900 along a direction away from the second connecting portion 904 is formed with a plurality of rows of spacing-adjusting insertion hole sets 905. The rows are arranged in the transverse direction of the plate base body 900 and are parallel to one another. As shown in FIG. 14, the spacing-adjusting insertion hole set 905 in each row includes a left insertion hole 905L, a central insertion hole 905C, and a right insertion hole 905R. The insertion holes 905L, 905C, and 905R in each row are transversely arranged. Each of the left insertion hole 905L and the right insertion hole 905R is formed with a hooking wall 9051 on the inner wall thereof. Referring to FIG. 10 and FIG. 14, in certain embodiments, the load-carrying fastener 9 includes a spacing-adjusting insertion member 93. The spacing-adjusting insertion member 93 is integrally formed of a plasticized material (e.g., rubber, etc.) and includes a left insertion member 93L, a central insertion member 93C, and a right insertion member 93R. The insertion members 93L, 93C, and 93R are transversely arranged, and each of the left and right insertion members 93L and 93R is connected to the left or right side of the central insertion member 93C by an elastic arm 930. The left and right insertion members 93L and 93R match the left and right insertion holes 905L and 905R in configuration respectively, and the front side of each of the left and right insertion members 93L and 93R is protrudingly formed with a locking hook 9310. The locking hooks 9310 match the hooking walls 9051 in configuration so that when the insertion members 93L, 93C, and 93R are inserted into a selected set of the insertion holes 905L, 905C, and 905R respectively, each locking hook 9310 is hooked to the corresponding hooking wall 9051. Thus, depending on a military person or police officer's choice and the specifications of the carrier in use, the spacing-adjusting insertion member 93 allows a clamping space R not only to be easily, rapidly, and precisely formed between the fastener base 90 and the pivotable locking plate 91 and between the spacing-adjusting insertion member 93 and the locking arms 9011, but also to be adequately sized to receive the carrier clamped between the fastener base 90 and the pivotable locking plate 91 (i.e., to match the specifications of the carrier). In other words, regardless of the specifications of the carrier, the military person or police officer will always be able to insert the spacing-adjusting insertion member 93 easily, rapidly, and precisely into the spacing-adjusting insertion hole set 905 corresponding to the specifications of the carrier and then clamp the carrier rapidly and securely between the fastener base 90 and the pivotable locking plate 91. This design allows a MOLLE accessory for use by a military person or police officer on duty to be securely inserted into its attachable holder M hung on the load-carrying fastener 9, to be carried around by the military person or police officer with ease, and to be used whenever needed to deal with an emergency that occurs while the military person or police officer is on duty; moreover, when properly attached to the carrier in use as a whole, the load-carrying fastener 9, the attachable holder M, and the MOLLE accessory will in no circumstances become loose, fall off, or get lost.

In certain embodiments, in order to lock the load-carrying fastener 9 even more securely to the carrier worn by a military person or police officer, and further ensure that the load-carrying fastener 9 will not get loose or fall off in any circumstances (e.g., when violently shaken, swung, hit, pulled, etc.; when the materials used undergo elastic fatigue; when related elements (e.g., the foregoing hooking portion 320 or engaging wall 360) are worn or damaged; etc.), referring to FIG. 9 and FIG. 10, the front side of the pivotable locking plate 91 is formed with a plurality of rows of positioning hole sets 915. The rows are arranged in the transverse direction of the pivotable locking plate 91 and correspond in position to the plurality of rows of insertion hole sets 905 respectively. As shown in FIG. 10, the positioning hole set 915 in each row includes a left positioning hole 915L, a central positioning hole 915C, and a right positioning hole 915R. The positioning holes 915L, 915C, and 915R in each row are transversely arranged. Referring to FIG. 14, the rear side of each of the left insertion member 93L, the central insertion member 93C, and the right insertion member 93R is protrudingly formed with a positioning post 9320, and the positioning posts 9320 match each positioning hole set 915 in configuration so that after the insertion members 93L, 93C, and 93R are inserted into a selected set of insertion holes 905L, 905C, and 905R respectively, and the fastener base 90 and the pivotable locking plate 91 are closed with respect to, and combined as a whole with, each other around a carrier, the spacing-adjusting insertion member 93 is securely positioned at a predetermined position and will not get loose or be displaced. This ensures that the load-carrying fastener will stay securely hung on the carrier.

In certain embodiments, the spacing-adjusting insertion member 93 is made of a material with higher elasticity than the plate base body 900 and the plate body 910 so that a military person or police officer can insert the spacing-adjusting insertion member 93 into the fastener base 90 and pull the spacing-adjusting insertion member 93 away from the fastener base 90 with greater ease and rapidity to enable fast and precise adjustment of the clamping space R between the fastener base 90 and the pivotable locking plate 91 according to the specifications of the carrier worn on the body of the military person or police officer, thereby allowing the load-carrying fastener 9 to be clamped on the carrier rapidly and securely, and a MOLLE accessory needed for duty to be inserted securely into the corresponding attachable holder M hung on the load-carrying fastener 9, to be carried around by the military person or police officer conveniently, and to be used whenever needed to tackle an emergency taking place while the military person or police officer is on duty. When properly attached to the carrier as a whole, the load-carrying fastener 9, the attachable holder M, and the MOLLE accessory will therefore in no circumstances become loose, fall off, or get lost.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A load-carrying fastener with rapid attachment and detachment and safety lock mechanisms, applicable to an attachable holder for a modular lightweight load-carrying equipment (MOLLE) accessory so that the attachable holder carries the MOLLE accessory and is hung on a carrier, wherein the attachable holder is formed with a storage opening on a lateral side thereof that allows the MOLLE accessory to be passed therethrough and be stored and fastened in a receiving space formed in the attachable holder, and with a connecting portion on a rear side of the attachable holder, and comprising:

a fastener base comprising a plate base body, wherein each of two lateral sides of the plate base body is formed with an elastic arm that extends toward a top side of the plate base body, compression-recoil gaps are formed between the elastic arms and the plate base body, each of the compression-recoil gaps allows a corresponding one of the elastic arms to be subjected to an elastic force that pushes the corresponding elastic arm toward the other elastic arm, and to an elastic force that pushes the corresponding elastic arm further away from the other elastic arm, a lock-release space is formed between corresponding inner portions of the elastic arms that are respectively adjacent to top side of the elastic arms, a rear side of the plate base body is formed with a connecting portion adjacent to the top side of the plate base body, a configuration of the connecting portion of the plate base body matches a configuration of the connecting portion of the attachable holder, the plate base body is configured to be attached to the attachable holder through the connecting portions, a top side of each of the elastic arms is formed with a locking arm that extends rearward of the elastic arm, and a free end of the locking arm is formed with a first locking hook;

a pivotable locking plate comprising a plate body that matches the plate base body in configuration and has a bottom end configured to be pivotally connected with a bottom end of the plate base body and allow the plate body to be flipped open from, and closed back on, the rear side of the plate base body, and formed with two locking holes that are adjacent to a top edge of the pivotable locking plate, correspond respectively in position to, and match respectively in configuration, the locking arms and the first locking hooks, and allow the locking arms to be inserted therein respectively when the plate body is closed on the rear side of the plate base body, wherein each of the first locking hooks is configured to hook a hole edge of a corresponding one of the locking holes to keep the plate body in a locked state in which the plate body is closed on the rear side of the plate base body, and be disengaged from the hole edge to bring the plate body to an unlocked state to allow the plate body to be flipped open from the rear side of the plate base body when pressing portions on outer sides, and adjacent to top edges, of the elastic arms are pressed simultaneously and the elastic arms are brought closer to each other; and a lock-release key having a rear side configured to be pivotally connected to a top edge of the plate body, matching the lock-release space in configuration, and configured to be flipped forward to a locking position where the lock-release key is engaged in the lock-release space to keep the pivotable locking plate and the fastener base in an interlocked state, and be flipped rearward to a released state in which the lock-release key is disengaged from the lock-release space.

2. The load-carrying fastener according to claim 1, wherein a side of each of the elastic arms that faces the lock-release space is provided with at least one first engaging unit adjacent to the top edge of the elastic arm, and each of two lateral end edges of the lock-release key is provided with at least one second engaging unit matching the first engaging unit in configuration and configured to engage the first engaging unit to keep the pivotable locking plate and the fastener base in the interlocked state.

3. The load-carrying fastener according to claim 1, wherein the plate base is integrally formed of a plasticized material.

4. The load-carrying fastener according to claim 1, wherein the pivotable locking plate is integrally formed of a plasticized material.

5. The load-carrying fastener according to claim 1, further comprising a spacing-adjusting insertion member comprising a left insertion member, a central insertion member and a right insertion member that are transversely arranged, each of the left and right insertion members being connected to a left or right side of the central insertion member by an elastic arm, wherein a portion of the plate base body along a direction away from the second connecting portion is formed with a plurality of rows of spacing-adjusting insertion hole sets, the rows are arranged in a transverse direction of the plate base body and are parallel to one another, each of the spacing-adjusting insertion hole sets comprises a left insertion hole, a central insertion hole and a right insertion hole that are transversely arranged, each of the left insertion hole and the right insertion hole is formed with a hooking wall on the inner wall thereof, the left and right insertion members match the left and right insertion holes in configuration, respectively, a front side of each of the left and right insertion members is formed with a second locking hook matching the hooking wall in configuration and configured to be hooked to the hooking wall when the left, central and right insertion members are inserted into the left, central and right insertion holes, and the spacing-adjusting insertion member is configured to size a clamping space for clamping the carrier that is formed between the fastener base and the pivotable locking plate and between the spacing-adjusting insertion member and the locking arms.

6. The load-carrying fastener according to claim 5, wherein a rear side of each of the left insertion member, the central insertion member and the right insertion member is protrudingly formed with a positioning post, and the positioning posts match in configuration each of positioning hole sets formed on the pivotable locking plate and are configured to position the spacing-adjusting insertion member at a predetermined position and position the load-carrying fastener to stay hung on the carrier after the left, central and right insertion members are inserted into the left, central and right insertion holes and the fastener base and the pivotable locking plate are closed with respect to each other around the carrier.

7. The load-carrying fastener according to claim 6, wherein the spacing-adjusting insertion member is integrally formed of a plasticized material.

8. The load-carrying fastener according to claim 7, wherein the spacing-adjusting insertion member is made of a material with higher elasticity than the plate base body.

* * * * *